US012674306B2

(12) United States Patent
Cornils et al.

(10) Patent No.: US 12,674,306 B2
(45) Date of Patent: Jul. 7, 2026

(54) IMMERSIVE BATHROOM AND KITCHEN DEVICES

(71) Applicant: Kohler Co., Kohler, WI (US)

(72) Inventors: Helene L. Cornils, Lafayette, IN (US); John O. Lipinski, Sheboygan, WI (US); Dongha Lee, Sheboygan, WI (US); Xinyao Liu, Wauwatosa, WI (US); Dustin Lobner, Port Washington, WI (US); Jacob Planton, Sheboygan Falls, WI (US); Fred Ogreenc, Cedar Grove, WI (US); Mark Schibur, Sheboygan, WI (US); Steven Mark Tervo, Oxford, WI (US); Rebecca Becker, Kohler, WI (US)

(73) Assignee: Kohler Co., Kohler, WI (US)

( * ) Notice: Subject to any disclaimer, the term of this patent is extended or adjusted under 35 U.S.C. 154(b) by 319 days.

(21) Appl. No.: 18/225,963

(22) Filed: Jul. 25, 2023

(65) Prior Publication Data

US 2024/0044118 A1 Feb. 8, 2024

Related U.S. Application Data

(60) Provisional application No. 63/395,181, filed on Aug. 4, 2022.

(51) Int. Cl.
*E03C 1/05* (2006.01)

(52) U.S. Cl.
CPC ..... *E03C 1/057* (2013.01); *E03C 2201/00* (2013.01)

(58) Field of Classification Search
CPC ..... E03C 1/057; E03C 2201/00; E03C 1/055
See application file for complete search history.

(56) References Cited

U.S. PATENT DOCUMENTS

| | | | | |
|---|---|---|---|---|
| 1,073,895 | A | 9/1913 | Fritz | |
| 5,171,429 | A | 12/1992 | Yasuo | |
| 6,731,429 | B2 | 5/2004 | Lunde | |
| 7,054,045 | B2 | 5/2006 | Mcpheters et al. | |
| 7,467,874 | B2 | 12/2008 | Gautschi | |
| 7,553,076 | B2 | 6/2009 | An | |
| 7,576,727 | B2 | 8/2009 | Bell | |
| 7,701,439 | B2 | 4/2010 | Hillis et al. | |
| 7,819,136 | B1 * | 10/2010 | Eddy | G01F 15/003 137/624.11 |

(Continued)

FOREIGN PATENT DOCUMENTS

| | | | |
|---|---|---|---|
| CN | 104455695 | A | 3/2015 |
| CN | 217463397 | U | 9/2022 |

(Continued)

OTHER PUBLICATIONS

Chinese Office Action from Chinese Patent Application1 (including English translation).

*Primary Examiner* — Janie M Loeppke
(74) *Attorney, Agent, or Firm* — Lempia Summerfield Katz LLC

(57) ABSTRACT

In one example, a timing control system for a faucet for dispensing water includes a valve sensor, a timer, and a light. The valve sensor is configured to detect operation of the faucet. The timer is configured to trigger a countdown in response to the operation of the faucet. The light is configured to illuminate the water of the faucet in at least one color in response to the countdown.

17 Claims, 13 Drawing Sheets

(56) References Cited

U.S. PATENT DOCUMENTS

| | | | | |
|---|---|---|---|---|
| 8,328,367 | B2 | 12/2012 | Nemeth et al. | |
| 8,479,765 | B1 | 7/2013 | Wren | |
| 8,665,673 | B2 | 3/2014 | Zhou | |
| 8,807,521 | B2 * | 8/2014 | Dunki-Jacobs | E03C 1/057 251/129.04 |
| 9,072,973 | B2 | 7/2015 | Elliott | |
| 9,157,219 | B2 * | 10/2015 | Gibson | E03C 1/048 |
| 9,377,874 | B2 | 6/2016 | Aull et al. | |
| 9,959,082 | B2 | 5/2018 | Dominique | |
| 10,268,277 | B2 | 4/2019 | Kang et al. | |
| 10,738,954 | B2 | 8/2020 | Bruls | |
| 10,993,587 | B2 | 5/2021 | Ophardt et al. | |
| 2004/0258567 | A1 * | 12/2004 | Kokin | F21V 33/004 422/68.1 |
| 2008/0204668 | A1 | 8/2008 | Dammura et al. | |
| 2008/0271795 | A1 | 11/2008 | Buhlmann | |
| 2017/0333799 | A1 | 11/2017 | Park | |
| 2019/0001006 | A1 * | 1/2019 | Rodenbeck | A61L 2/24 |
| 2019/0392739 | A1 | 12/2019 | Kimura et al. | |
| 2021/0195712 | A1 | 6/2021 | Miller | |
| 2021/0322824 | A1 | 10/2021 | Evans et al. | |
| 2022/0008591 | A1 | 1/2022 | Smith | |
| 2022/0064919 | A1 | 3/2022 | Beber et al. | |
| 2024/0044118 | A1 | 2/2024 | Cornils | |

FOREIGN PATENT DOCUMENTS

| | | | |
|---|---|---|---|
| JP | 2004211339 | A | 7/2004 |
| JP | 2006125060 | A | 5/2006 |
| JP | 2019056272 | A | 4/2019 |
| KR | 20190059748 | A | 5/2019 |
| WO | 2006072399 | A1 | 7/2006 |
| WO | 2012172820 | A1 | 12/2012 |
| WO | 2017141619 | A1 | 8/2017 |
| WO | 2021104867 | A1 | 6/2021 |
| WO | 2023009765 | A2 | 2/2023 |

* cited by examiner

IMMERSIVE BATHROOM AND KITCHEN DEVICES

CROSS REFERENCE TO RELATED APPLICATIONS

This application claims priority benefit of Provisional Application No. 63/395,181 filed Aug. 4, 2022, which is hereby incorporated by reference in its entirety.

FIELD

The present application relates to immersive sensory devices for a shower, faucet, bathtub or other bathroom device.

BACKGROUND

Shower devices and faucet devices provide water for usage by a user in a bathroom setting. Various systems have been provided to make these devices more pleasant or enjoyable for the user. One such example may include water jets to simulate the sense of touch or massage. Another example may include a speaker to produce music or other sounds to stimulate the user's sense of hearing. The following embodiments describe additional techniques to stimulate the user's senses for devices in the bathroom setting.

BRIEF DESCRIPTION OF THE DRAWINGS

Exemplary embodiments are described herein with reference to the following drawings, according to an exemplary embodiment.

DETAILED DESCRIPTION

The following embodiments include plumbing devices such as faucets, bathtubs, and showers. The plumbing devices may include sensory features that relate to sound, touch, or sight to add features to the plumbing device. The term "plumbing fixture" refers to an apparatus that is connected to a plumbing system of a house, building or another structure. The term "bathroom fixture" may more specifically refer to individual types of plumbing fixtures found in the bathroom. The term "kitchen fixture" may more specifically refer to individual types of plumbing fixtures found in the kitchen.

Figure 1:
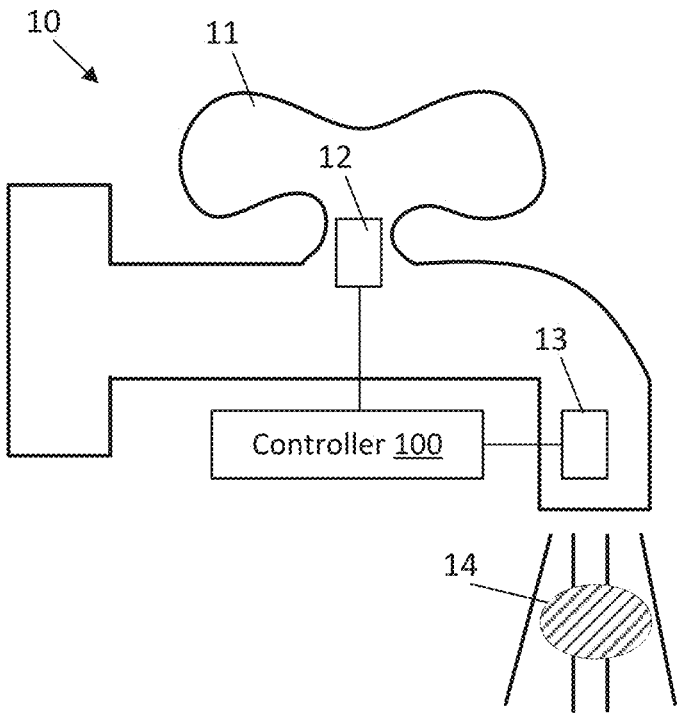
FIG. 1 illustrates an apparatus faucet with a sensory timer.

FIG. 1 illustrates a faucet 10 including a handle 11, a valve 12, and a light 13. The valve 12 and/or light 13 may be electrically coupled to a controller 100. The faucet 10 may be a bathroom faucet, a kitchen faucet, or any type of faucet or water dispenser. The faucet embodiments may be applied to a showerhead. The light 13 may be directly mounted to the faucet (e.g., on the inside of the faucet). Additional, different, or fewer components may be included.

The controller 100 may include a timer for measuring the operation time of the faucet 10. The timer may be preloaded with predetermined handwashing times. One example handwashing time is 20 seconds. Various other default handwashing times may be used and be selected according to geographic location or current events such as health status in a community. In other examples, different users may specify specific handwashing times. For example, the controller 100 may connect to a user input (e.g., phone, tablet, or other mobile device) through wireless communication to send the handwashing time to the controller 100.

The timer of the controller 100 may begin to count time in response to the valve 12. For example, when a user turns on water flow through the faucet 10 by turning the handle 11, the valve 12 is turned on. The valve 12 may be coupled to a sensor that detects the actuation of the valve 12 and sends data indicative of the actuation of the valve 12 to the controller 100. The controller 100 causes the timer to count time representative of handwashing operation in response to the data indicative of the actuation of the valve 12. In another example, a proximity sensor may detect the presence of hands at or near the faucet 10 as representative of the handwashing operation.

The controller 100 also may be configured to control the valve 12. That is, the controller 100 may send a command to the valve 12 to open the flow of water. The valve 12 may include a solenoid or a motor that opens the valve 12. The controller 100 may open the valve when prompted by a user. The user may prompt the controller by placing a hand or otherwise making a gesture detected by a proximity sensor for the valve 12. The user may prompt the controller 100 by verbally providing an instruction to a microphone associated with the valve 12. The user may prompt the controller 100 by use of a wireless device such as a phone or tablet. In any of these examples, the timer of the controller 100 may begin to count time in response to the user prompt.

The controller 100 may send commands to the light 13 indicative of a handwashing operation. The controller 100 may cause the light 13 to illuminate in response to the handwashing operation. In some examples, the light 13 includes multiple lights of different colors. The light 13 may include a light operable in different colors. The light 13 may include multiple lights in a cluster, each having a different color. The light or lights may be light emitting diodes (LEDs). The multiple lights may include a green light and a red light. Any colors or combinations of colors may be used.

The light 13 may be visible at the faucet 10 such as shining out of the opening of the faucet. The light 13 may be projected (e.g., as projections 14) on the water that is provided out of the opening of the faucet.

The controller 100 may cause the light 13 to illuminate in a sequence of colors in response for the handwashing operation. One command for the sequence of colors may cause one color to illuminate, and another command for the sequence of colors may cause another color to illuminate.

Different colors for the sequence of commands may be associated with different portions of the handwashing operation. For example, the first portion of the handwashing operation as defined by the count time may cause the first color to illuminate and the second portion of the handwashing operation as defined by the count time may cause the second color to illuminate. The first portion of the count time may be the first half and the second portion may be the second half. The second portion of the count time may be the last 10 seconds and the first portion of the count time may be the time until the last 10 seconds.

For example, the controller 100 may start counting the count time in response to data indicative of the opening of the valve 12. Once the valve 12 has opened the controller 100 sends a command to a first color in the light 13 (e.g., green light, white light, blue light). After the count time has elapsed to a predetermined time threshold (e.g., final 10 seconds, final 5 seconds), the controller 100 sends a command to a second color in the light 13 (e.g., red light, yellow light) to indicate the urgency or otherwise indicate that the prescribed handwashing time is almost over. In other examples, three stages or more may be used for different timing in the count down and for different colors.

Figure 2:
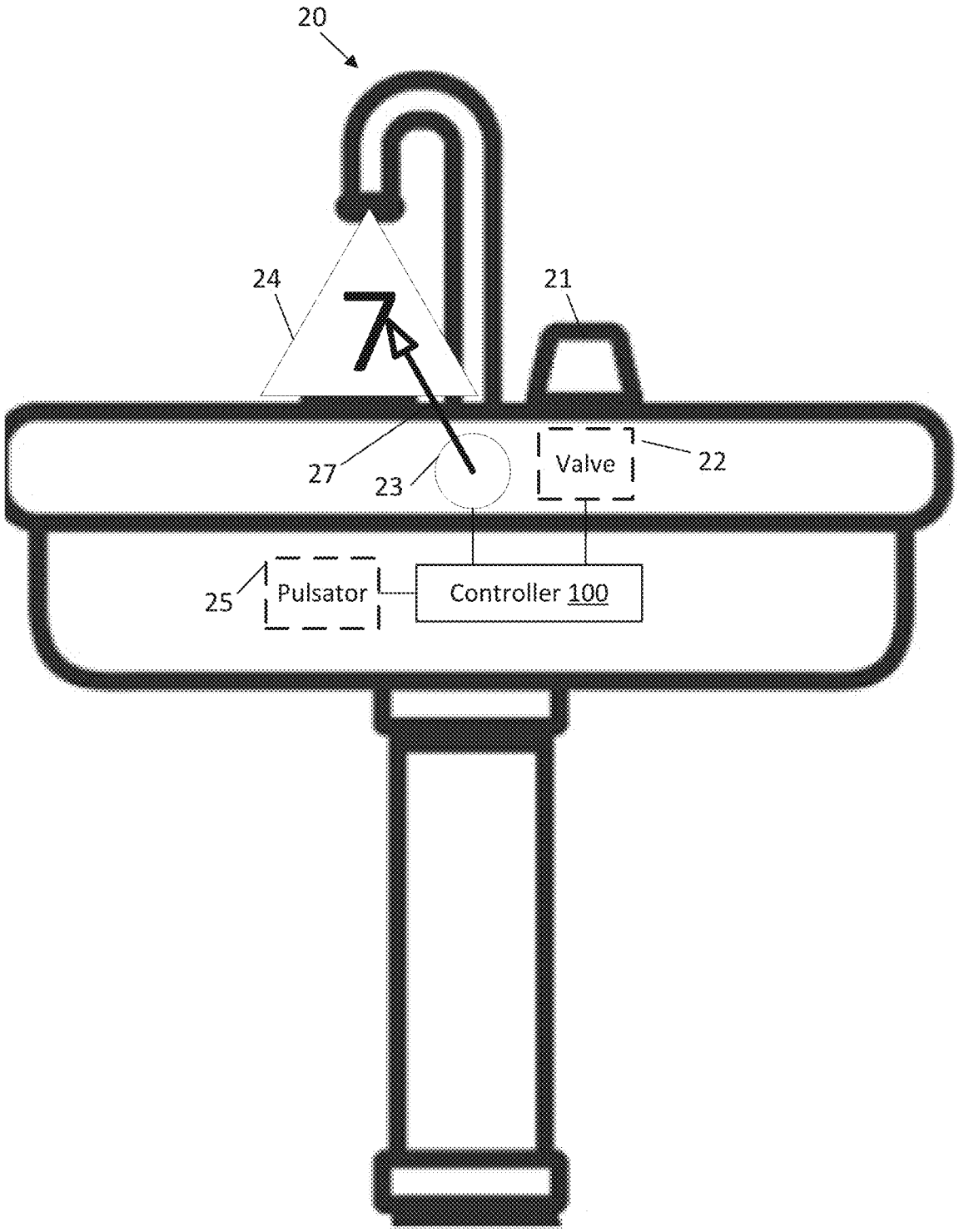
FIG. 2 illustrates another faucet with a sensory timer and projector.

FIG. 2 illustrates a faucet 20 including a handle 21 connected to a valve 22, and a projector 23. Multiple handles 21 and valves 22 may be used, for example, corresponding to hot and cold water or different water sources. The valve 22 and/or projector 23 (light source) may be electrically coupled to a controller 100. The projector 23 may be mounted in the basin or in another location where the projector 23 can project light on the water dispensed from the faucet 20. Additional, different, or fewer components may be included.

The faucet 20 dispenses water 24. The water 24 may be in the shape of a spray or fan. The fan may be caused by a flat nozzle having a substantially rectangular cross section. The fan may spread the cross section of the water 24 over one direction in order to maximize the surface area of the flow of water coming from the faucet 20.

The controller 100 may include a timer for measuring the operation time of the faucet 20. The timer may be preloaded with predetermined hand washing times or hand washing times may be specified by users. The timer of the controller 100 may begin to count time in response to the valve 22. For example, when a user turns on water flow through the faucet 20 by turning the handle 21, the valve 22 is turned on. The valve 22 may be coupled to a sensor that detects the actuation of the valve 22 and sends data indicative of the actuation of the valve 22 to the controller 100. The controller 100 causes the timer to count time representative of handwashing operation in response to the data indicative of the actuation of the valve 12. In another example, a proximity sensor may detect the presence of hands at or near the faucet 10 as representative of the handwashing operation.

In the case of a showerhead, the timer of the controller 100 may related to shower times, which may be based on an exercise routine or a user's biological parameters such as heart rate, temperature, or other factors. The projector 23 may project the time remaining and/or indicative colors on the water dispensed from the showerhead.

The controller 100 may send commands to the projector 23 to produce light 27 that is projected onto the water 24. In one example, the projected light 27 indicates the elapsed time of the handwashing operation as counted by the timer of the controller 100. For example, the elapsed time may be an indicia (e.g., alphanumeric characters) for a number of seconds (e.g., 7 seconds counting up as shown in FIG. 2). In another example, the projected light 27 indicates the remaining time in the handwashing operation. For example, the remaining time may be a number of seconds (e.g., 7 seconds counting down as shown in FIG. 2).

The projected light 27 may be projected through a lens of the projector 23. The projected light 27 may scan across the water 24 from the projector 23 in rows by a laser beam. The projector 23 may iteratively scan multiple rows of pixels on the image to create the numbers of the countdown.

In another example, the projector 23 includes lights arranged in a seven segment display. That is, each light arranged in a shape or otherwise shines through a seven segment pattern. When one seven segment display is used, the projector 23 may project the last 9 seconds of the count down onto the water 24. When two seven segment displays are used, the entire countdown may be projected onto the water 24.

In some examples, the controller 100 may also send instructions to a pulsator in response to the count down and/or handwashing operation. The pulsator 25 may be connected to the water line (water supply) and be configured to add haptic feedback to the water 24. The pulsator 25 may cause the water to pulse or pulsate. The controller 100 may send instructions to the pulsator 25 at a predetermined interval during the countdown.

For example, the controller 100 may start counting the count time in response to data indicative of the opening of the valve 12. Once the valve 12 has opened the controller 100 sends a command to a first color in the light 13 (e.g., green light, white light, blue light). After the count time has elapsed to a predetermined time threshold (e.g., final 10 seconds), the controller 100 sends a command to a second color in the light 13 (e.g., red light, yellow light). After the count time has elapsed to a second predetermined time threshold (e.g., final seconds), the controller 100 sends a command to the pulsator 25 to send pulses through the flow of water to indicate the urgency or otherwise indicate that the handwashing time is almost over.

The pulsator 25 may create the pulses using a variety of techniques. The pulsator 25 may include one or more impellers that are turned off by the instructions from the controller 100.

The pulsator 25 may include at least one fluidic oscillator that is activated by a valve 221 by the instruction from the controller 100. In one position the valve 221 causes the water supply to bypass the fluidic oscillator 101 and in another position, the valve 221 causes the water supply to flow through the fluidic oscillator 101 (or a set of fluidic oscillators). The fluidic oscillator 101 includes interconnected flow channels (e.g., passages, etc.) that include geometries which may be altered to selectively control the flow of water ejected as water 24. For example, the channels may be configured to provide pulsating or oscillating flows of water to achieve haptic feedback in response to the hand washing countdown.

Figure 3:
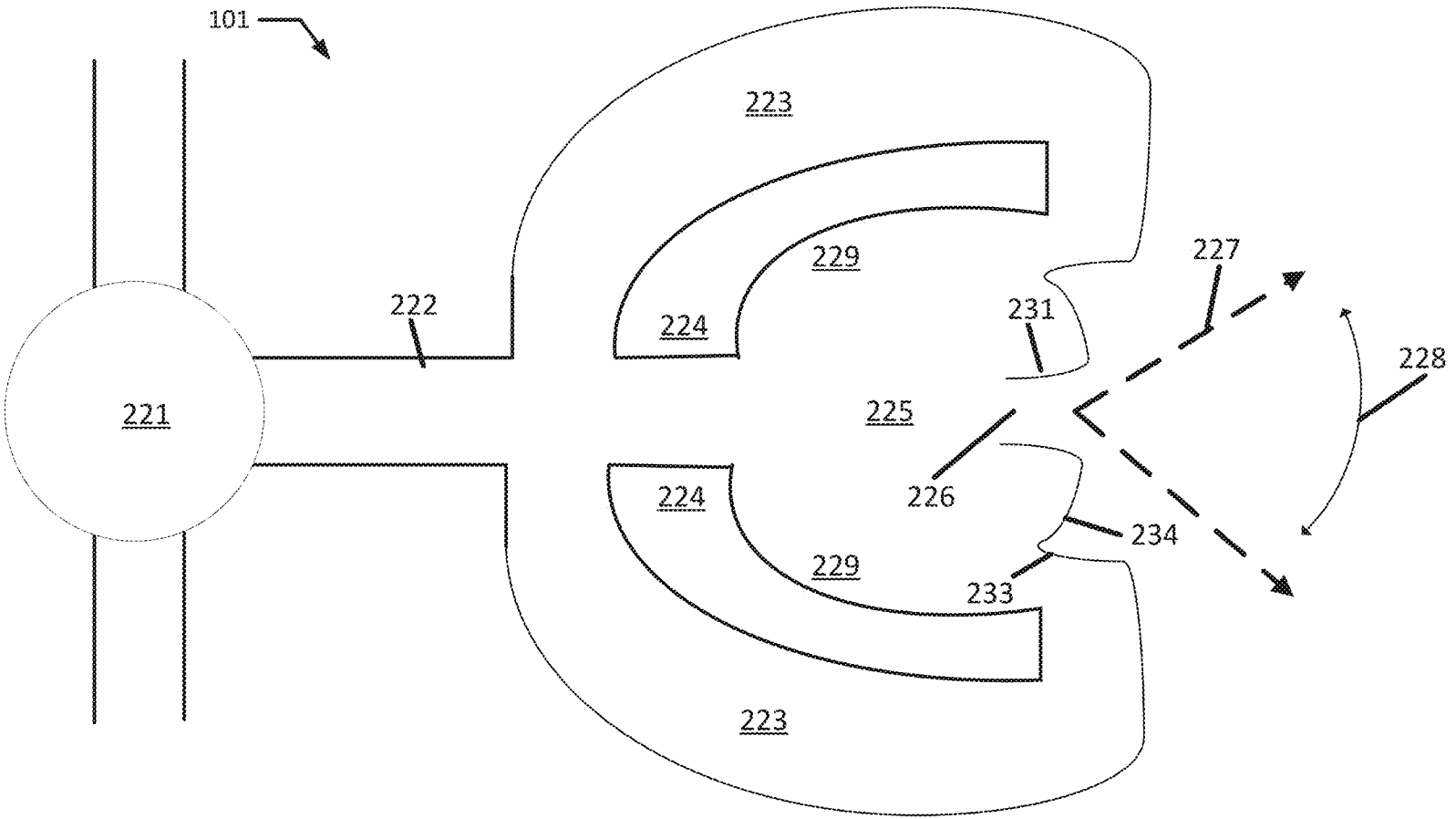
FIG. 3 illustrates an example fluidic oscillator for use with the faucets of FIGS. 1 and/or 2.

FIG. 3 illustrates an example of a fluidic device module or fluidic oscillator 101 including multiple examples of the passive passage. The passive passage may include a diffuser, a feedback channel, an amplifier, or a diverter. Illustrated is an internal cross section of the fluidic oscillator 101 at a position between a top (inlet) and a bottom (outlet) of the fluidic oscillator 101. The fluidic oscillator 101 includes a main flow channel 222, one or more feedback channels 223, an island 224, a mixing chamber 225, an outlet 226 and one or more geometric features at the outlet of the fluidic oscillator 101 that cause a fan output water flow 227 to oscillate, fluctuate, or pulsate across a predetermined angle range 228. The angle range 228 of the water flow 227 may be in a fan shape suitable for the projection of light indicative of the handwashing timer. The main flow channel 222 may include a narrowing passage that acts as an amplifier for the velocity of the flow of water. For example, the positions of the islands 224 may be adjusted to create such a narrowing passage and amplifier. Additional, fewer, or different components may be used.

The fluidic oscillator 101 includes a main flow channel 222 at least partially in parallel to one or more feedback channels 223. As shown in FIG. 3, each of the feedback channels 223 is substantially parallel in part to the main flow channel 222 and each of the feedback channels 223 provides a path in the opposite direction (upstream) of the main flow channel 222 (downstream).

The fluidic oscillator 101 includes at least one island divider 224 configured to separate the mixing chamber 225 from each feedback channel 223. The divider 224 my partially or fully extend from the bottom to the top of the fluidic oscillator 101.

The fluidic oscillator 101 includes a mixing chamber 225 in communication with the main flow channel 222 and each of the feedback channels 223. The main flow channel 222 includes a pressurized fluid to create a spatially oscillating (fan sweep back and forth) jet. No power source is required. However, the input fluid (e.g., water supply) is provided under pressure or under with potential energy from gravity. The diameter of the pipe may be selected to increase or decrease the input fluid to a desired pressure. The curved walls of the mixing chamber 225 provide a path for the flow of fluid to exhibit the coanda effect in which the flow attaches itself to the walls of the mixing chamber 225 and changes direction because it remains attached as the curved walls of the mixing chamber 225 curve away from the initial direction from the main flow channel 222. In addition or in the alternative, the mixing chamber 225 provides one or more pockets 229 for a separation flow to form that is triggered from the output from the respective feedback channel 223. The separation flow pushes the main flow away from the walls of the mixing chamber 225 to cause the oscillation to be realized in the output of the fluidic oscillator 101.

The fluidic oscillator 101 includes one or more geometric features at the outlet of the fluidic oscillator 101 that cause a fan output water flow 227 to oscillate across a predetermined angle range 228. The fluidic oscillator 101 is self-sustaining and self-inducing by virtue of the shape of the main flow channel 222, the feedback channels 223, the island 224, and/or the mixing chamber 225.

In addition, one or more features of the outlet of the fluidic oscillator 101 applies a limiting condition (diffuser) on the fan output water flow 227 to oscillate across the predetermined angle range 228. The limiting condition may be a geometric feature of the outlet of the fluidic module 101. In one example, the limiting condition is provided by a geometry including a narrow neck 231 extended into the mixing chamber 225. The neck 231 limits the predetermined angle range 228 by blocking some of the flow of water that unimpeded would have escaped the mixing chamber 225 to the outlet of the fluidic oscillator 101. The narrow neck 231 may also set a particular oscillation frequency due to reflection of the fluid back into the fluidic oscillator 101. The neck 231 may be omitted to reveal a larger outlet of the fluidic module 101.

In one example, the limiting condition is provided by a geometry including a convex portion 233 that adjusts a path of the output of the feedback path 223. The convex portion 233 may direct the feedback flow of fluid into the pocket 229 at a smaller angle thus increasing the separation flow and, accordingly, the frequency of the output of the fluidic oscillator 101.

In one example, the limiting condition is provided by a geometry including a concave portion 234 configured to reverse the flow outside of the neck 231 internally into the mixing chamber 225. Fluid that otherwise would have flowed to the outlet of the fluidic oscillator 101 flows into the concave portion 234 then back into the rotational flow of the mixing chamber 225 as an additional feedback input to the mixing chamber 225. Thus, the concave portion 234 may be referred to as an auxiliary feedback for the fluidic oscillator 101.

Figure 4:
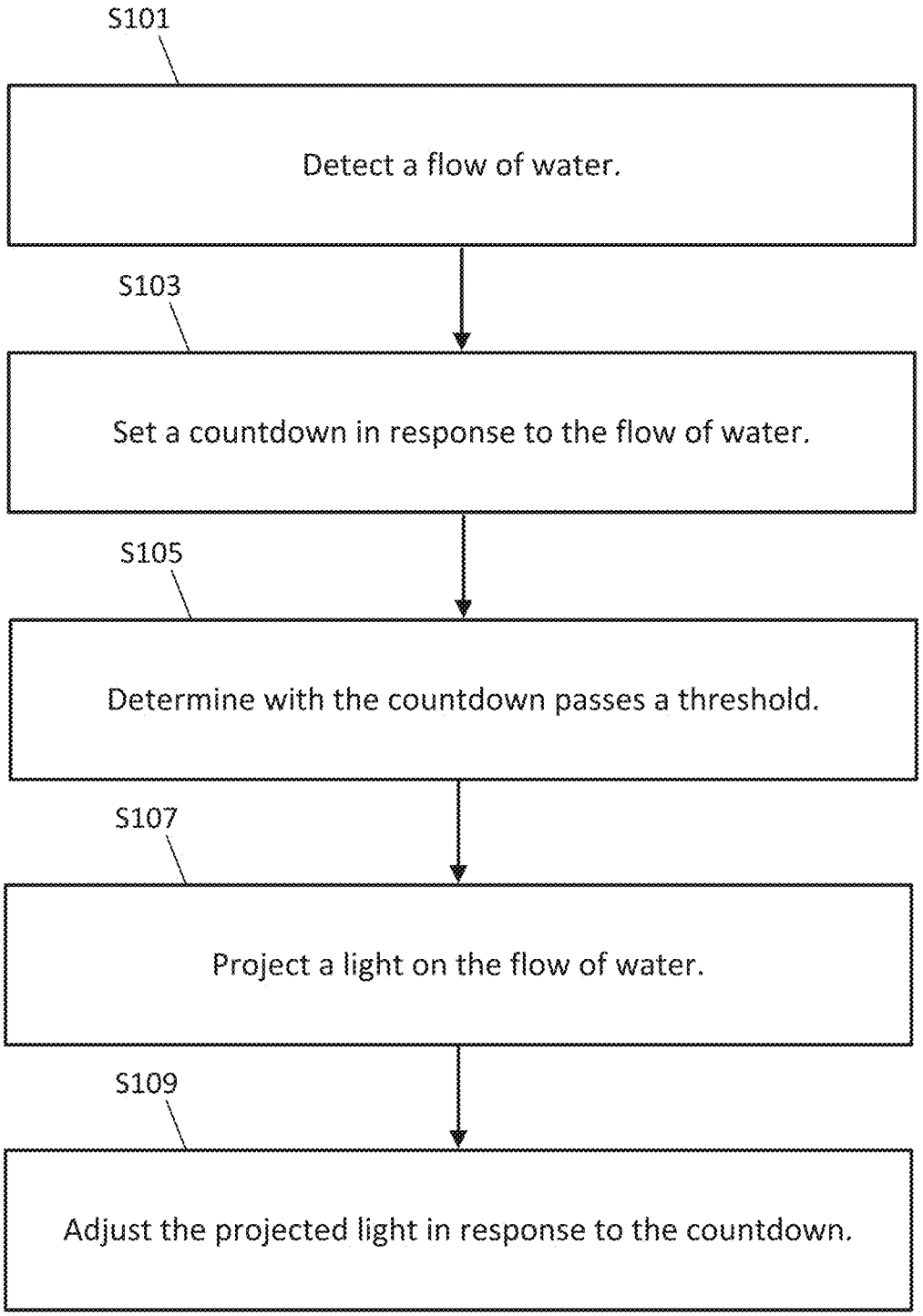
FIG. 4 illustrates an example flow chart for the faucet with sensory timer.

FIG. 4 illustrates a flow chart for the operation of the handwashing timer and faucet of any of the examples of FIG. 1-3. Additional, different, or fewer acts may be included.

At act S101, the controller 100 detect a flow of water from a valve sensor or from an internal instruction for the valve associated with a supply line for the faucet and associated basin. The valve sensor may detect the opening of a valve. The valve sensor may detect the rotation of a lever or knob for the valve. Sometimes, the controller 100 may send commands to a motor or solenoid to control the valve. In these examples, the controller 100 may monitor such commands to determine when the valve is in operation.

At act S103, the controller 100 sets a countdown in response to the flow of water. The controller 100 may access the value of the countdown from memory. The value for the countdown may be set by the user, set by another factor. The countdown may count up from zero to the countdown value or count down from the countdown value to zero.

At act S105, the controller 100 is configured to determine when the countdown passes the countdown threshold. The countdown threshold may be an interim value in the countdown (i.e., between zero and the countdown value). The controller 100 may trigger another action with the countdown threshold is met or exceeded. The other action may be shining a specific light, color, projection into or onto the water dispensed from the faucet. The other action may be a pulse or vibration applied to the water.

At act S107, the controller 100 is configured to cause a light to project a specific color or indicia on the flow of water. For example, the countdown threshold may be five seconds. Initially, the controller 100 illuminates the water in an initial color (e.g., green). Thus, when the controller 100 countdown reaches the final five seconds, the controller 100 illuminates the water in a specific color (e.g., red) to indicate to the user that the handwashing duration is almost over. Similarly, when the controller 100 countdown reaches the final five seconds, the controller 100 illuminates the water to provide indicia of the countdown (e.g., "5", "4", "3", etc.) as the countdown counts down so that the user sees the number of seconds remaining in the countdown. At act S109, adjust the projected light in response to the countdown.

Figure 5:
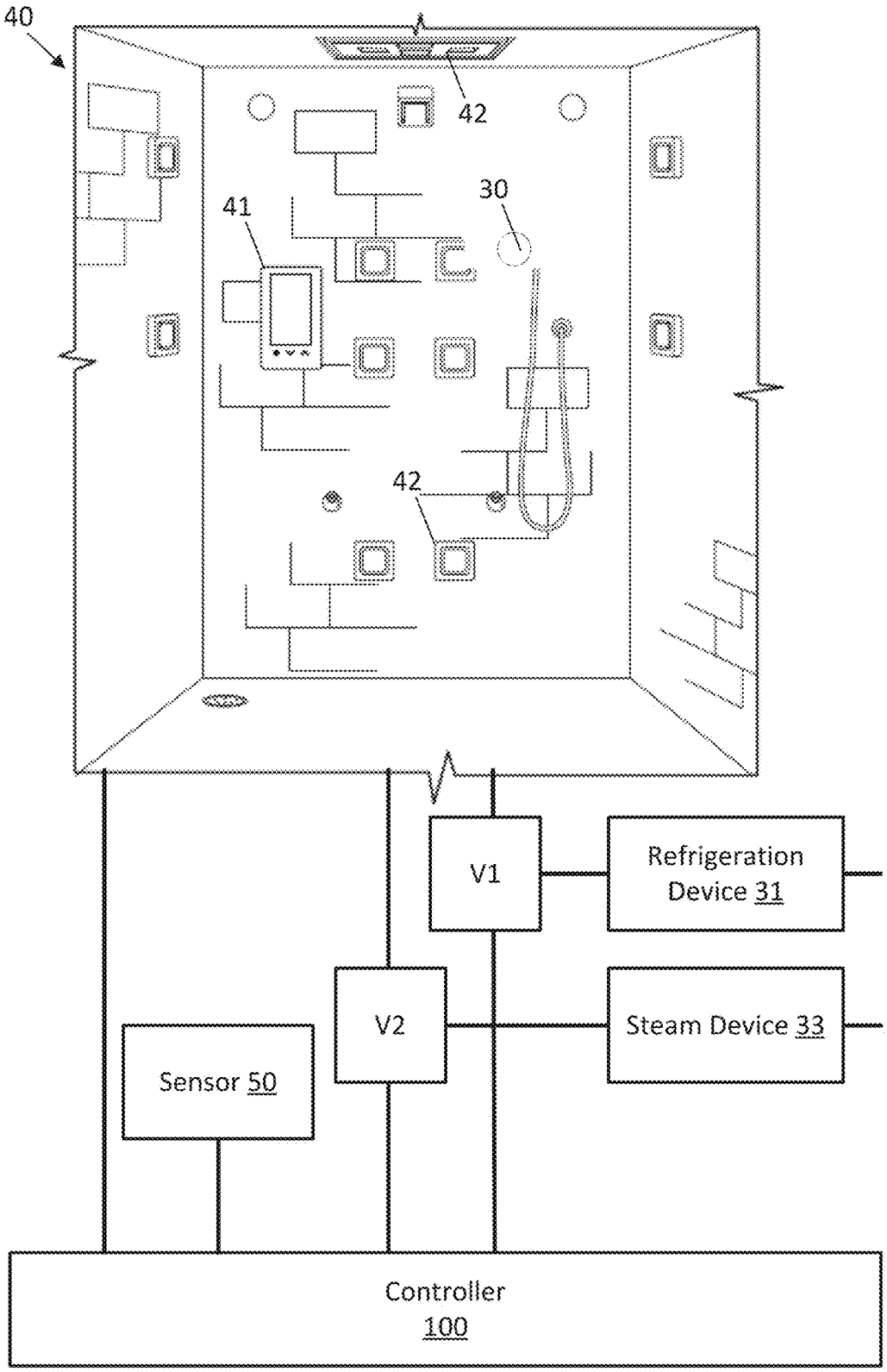
FIG. 5 illustrates an example of a shower with a sensory timing sequence.

FIG. 5 illustrates an example of a shower 40 with a sensory timing sequence. The shower 40 includes at least one sprayer 42 (e.g., showerhead, nozzle, handheld sprayer). The shower 40 may include an interface 41. The shower 40 may be coupled to one or more sensors 30 and/or one or more sensors 50 may be detached from the shower 40 and associated with users of the shower 40. The sensors 50 may be electrically connected to a mobile device (or electrically connected to the controller 100) using a wireless protocol such as Bluetooth or other radio frequency communication. The shower 40 may incorporate any of the timing and visual cues described with respect to FIGS. 1-4. Additional, different, or fewer components may be included.

The at least one sprayer 42 is connected to plumbing fixtures for providing water to the shower 40. The plumbing fixtures may include at least one cold pipe including a valve V1 and at least one hot pipe including a valve V2. The valve V1 may connect and/or bypass a refrigeration device 31 to the shower 40. The valve V2 may connect and/or bypass a steam device 33 to the shower 40.

The refrigeration device 31 is configured to chill, or remove heat from, water flowing through the cold pipe. The refrigeration device 31 may include multiple components including a compressor, a condenser, an expansion device, and an evaporator. The condenser may include one or more coils as a heat exchanger. The compressor may supply refrigerant vapor (e.g., high pressure and/or high temperature) to the condenser. The condenser causes the refrigerant vapor to liquid. The expansion device creates a drop in pressure. The evaporator is another heat exchanger that absorbs heat.

The steam device 33 is configured to heat the water flowing from the hot pipe. The steam device 33 may include an electric resistive heater powered by an electrical power supply. The resistive heater may heat the water in the hot point to near or at the boiling point of the water.

The controller 100 configured to receive a user parameter and activate the refrigeration device 31 or the valve V1 in response to the user parameter. The user parameter may be a biological property of the user. The biological property by include a body temperature, a heart rate, a blood oxygen level, or any combination thereof. The controller 100 configured to receive a user parameter and activate the steam device 33 or the valve V2 in response to the user parameter. Various sequences between the refrigeration device 31 and the steam device 33 may be used.

As shown in FIG. 5, the shower 40 may also include a shower sensor 30 physically connected to the shower 40. In addition or in the alternative, an external sensor 50 may take measurements of the user before entering the shower 40. The external sensor 50 may also take measurements of the user within the shower. The shower sensor 30 and/or the external sensor 50 may be a temperature sensor or thermometer that measures the body temperature of the user. The temperature sensor may be an infrared sensor. The temperature sensor may be a touch sensor that measures temperature through contact with the user.

The user may grip or otherwise touch the sensor for temperature as well as other readings. Example body readings of the user through contact include a pulse reader including a concave portion configured to receive a finger of the user. Alternatively, the pulse reader may include a clamp that is placed over a finger, ear lobe, or another body part. The pulse reader measures oxygen levels in the blood. The pulse reader may generate one or more beams of light that pass through the body part and detect the amount of light that passes through the body part. Because oxygenated and de-oxygenated blood absorb different amounts of light, the oxygen levels are calculated based on the received light.

The sensor may be an audio sensor such as a microphone that detects sounds produced by the user. Some sounds such as coughs, sneezes, or certain voice properties may indicate the health of the user. Some sounds include the breathing patterns of the user that may be indicative of heart rate or recent exercise by the user. The sensor may detect odors.

The sensor may detect volatile organic compounds (VOCs) or other carbon based (organic) chemicals (compounds) that are indicative of odors of health conditions.

The sensor may be an image collection device with a lens such as a digital aperture collection device (e.g., camera) or an image collection device with a charge coupled device (CCD) such as an integrated circuit formed on a silicon surface forming light sensitive elements. The image collection device may collect images for facial recognition of the user. The image collection device may collect images for recognizing an image signature of the user such as the color or shape (e.g., bone density, outline, height, and/or weight) of the user. Other body properties may be determined from the image of the user including skin qualities or conditions at a cellular level, signs of hormone imbalance, aging, sun damage, pigmentation, color, inflammation, environmental impacts, or other abnormalities. In another example, the images of the user's muscles are analyzed to determine muscle conditions (e.g., strains, pulls, or tears). The sensor may be a retina scanner configured to scan the eyes of the user. The retina scan may indicate an eye signature for identification of the user. The retina scan may detect characteristics of health such as the blood sugar level of the user.

A controller 100 may analyze the sensor data from the shower sensor 30 and/or the external sensor 50. The controller 100 may compare values in the sensor data to one or more thresholds or ranges in order to identify a shower sequence for the user. The sequence may include specific timings for activating/deactivating the steam device 33 or the valve V2 associated with the steam device 33 in response to the property of the body of the user. The sequence may include specific timings for activating/deactivating the refrigeration device 31 or the valve V1 associated with the refrigeration device 31 in response to the property of the body of the user. In application, the controller 100 may start a timer based on the property of the body of the user according to the sequence. The controller tracks the timer and deactivates the steam device 33 or the valve V2 associated with the steam device 33 and/or the refrigeration device 31 or the valve V1 associated with the refrigeration device 31 in response to the timer.

The controller 100 may include a memory that includes a lookup table with one or more sequences for the shower 40. One or more sequences may be optimized for muscle development. One or more sequences may include a gradual slope (e.g., predetermined slope for change in temperature versus change in time) or stair step application of temperatures provided by the shower 40. Each sequence includes one or more timing intervals (e.g., a start time and/or an end time) for activating the refrigeration device 31 and/or the steam device 33, as well as actuating, the valve V1 and/or the valve V2. The sequence may include activation of the refrigeration device 31 and supplying the chilled water to the shower 40 during a first time period and activation of the steam device 33 and supplying steam or very hot water during a second device period. In some examples, the refrigeration device 31 and/or the steam device 33 are left activated but bypassed via valves V1 and V2 during a third time period.

The sequences may be associated with the various user parameters of the users. That is, based on the measurements received from the sensor 30 and/or sensor 50, the controller 100 access a particular sequence. When body temperature is a first range, a first sequence is accessed, and when body temperature is in a second range, a second sequence is accessed. Similarly, different sequences may be accessed for oxygen levels, pulse rates, or other biological properties of the user.

The lookup table may associate certain sequences to different users. The users may have different sequences based on age, gender, exercise routines, or personal preferences. The user may select the sequence through interface 41 by selecting time intervals, orders, and temperatures of the refrigeration device 31 and the steam device 33. Once the sequence is set, the controller 100 may automatically apply the sequence through the measured user parameters.

For example, when the sensor data includes temperature values, the controller 100 may compare the temperature values to a normal human temperature value or range to identify when the user may have an elevated temperature. The normal temperature value may be predetermined (e.g., 98.6 F) or the normal temperature range (e.g., 97.5 to 99.5 F) may span values around the normal temperature value. Similar ranges may be applied to pulse, oxygen levels, breathing, or other properties.

In one example, a sequence for the steam device 33 may provide quick access to steam to aid in therapy or the application of medicine. This application may be applied to a faucet (e.g., faucet 10 of FIG. 1 or faucet 20 of FIG. 2). A user such as a child may be placed near the steam for exposure to oils or medicine to relief congestion. When the faucet is used, a small space may warm the user without use of a full bath or shower.

The controller 100 may send the result of the analysis to a display or user interface 41, as discussed in more detail below. The controller 100 may generate a message as an alert to the user when the temperature exceeds the threshold. The controller 100 may generate a log or journal for the sensor data. That is, the sensor data may be stored in memory with associated timestamps that record when the sensor data was collected. Likewise, the sensor data may be stored with identity of the user, which may be determined using any of the various techniques described herein.

Figure 6:
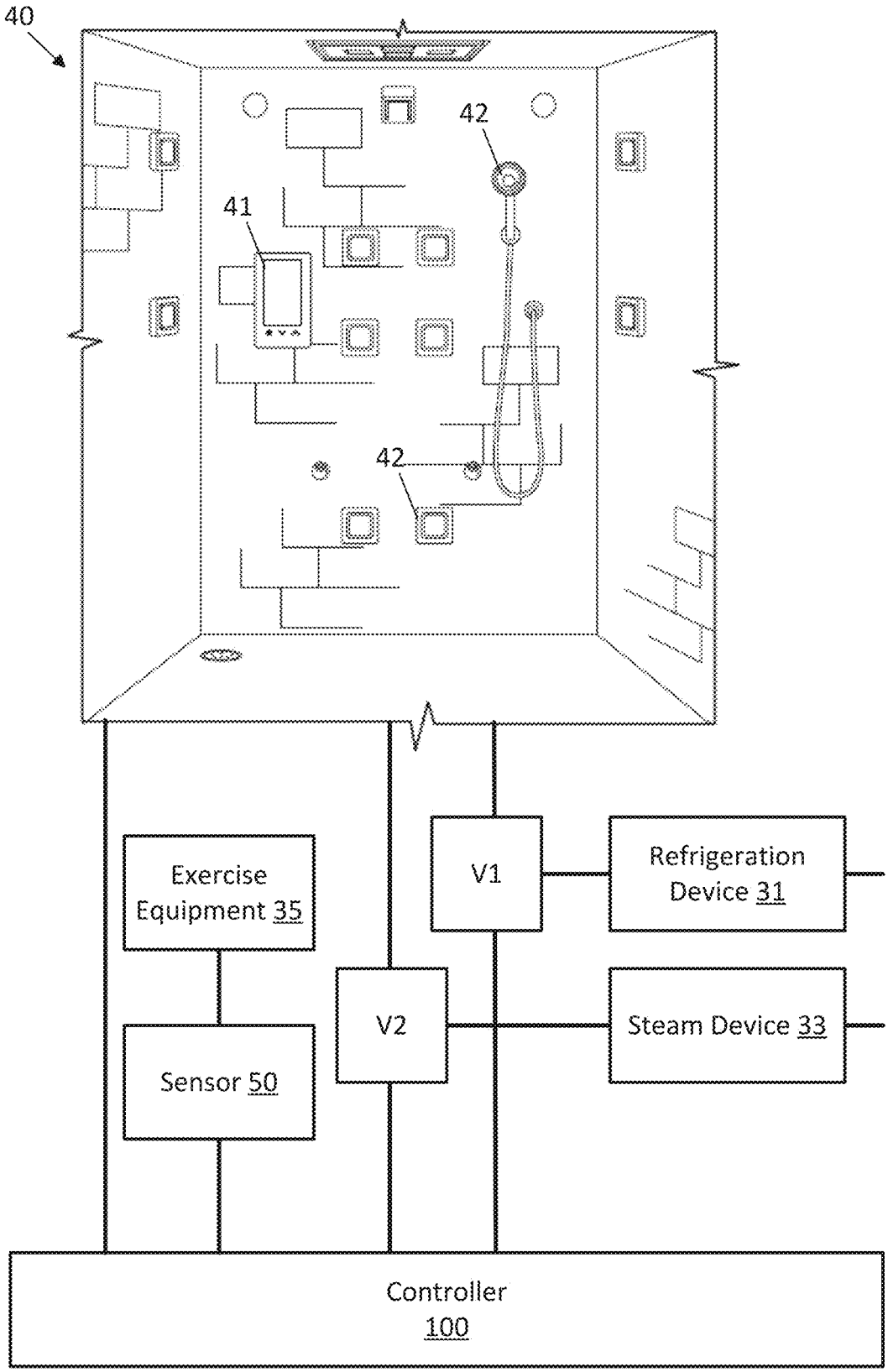
FIG. 6 illustrates another example of a shower with a sensory timing sequence in communication with exercise equipment.

FIG. 6 illustrates that exercise equipment 35 includes a sensor 50 configured to measure the user parameter. The exercise equipment 35 may send data from the sensor to the controller 100. The data may include a log of an exercise routine. For example, a series of measurements of heart rate, pulse, oxygen levels, or other values over time for the user during an exercise routine. The exercise equipment 35 may include a stationary bicycle, treadmill, elliptical machine or other device that provides exercise or otherwise a resistance to the human body. The exercise equipment 35 may stream data to the controller 100 or store data over time and subsequently deliver to the controller 100. The data may be average or otherwise sampled. In some examples, the exercise equipment 35 may be a bicycle, outdoor equipment, or otherwise out of wireless communication range with the controller 100. A mobile device (e.g., phone, tablet) may receive data from the exercise equipment 35 for subsequent upload to the controller 100.

The controller 100 may select the shower sequence according to the log of the exercise routine. In this way, based on the personalized and actual exercise routine of the user, the temperature sequence of the shower 40 is automatically determined. Based on the extent and duration of an elevated body temperature, high pulse rate, or specific oxygen levels, the controller 100 may selected a particular shower sequence with prescribed durations and sequences of intervals of chilled water and/or steam.

FIG. 6 illustrates an example flow chart for the shower with sensory timing sequence. Additional, different or fewer acts may be used.

At act S201, the controller 100 receives sensor data indicative of a property of a body of a user of the shower. The body property may include one or a combination of pulse, blood pressure, temperature, or oxygen level. At act S203, the controller 100 selects a target shower temperature in response to the property of the body of the user. At act S205, the controller 100 select a time interval. The time may be based on the property of the body of the user. At act S207, the controller 100 activates at least one heat exchanger or connected valve in response to the at least one body property. The heat exchanger may be included in a refrigeration device or a steam device that chills or heats water in a supply line for the shower. At act S209, the controller 100 deactivates the refrigeration device or a valve associated with the refrigeration device in response to the timer. The controller 100 may provide data or commands to a display configured to display data indicative of the at least one body property or activation of the at least one heat exchanger or the valve.

Figure 7:
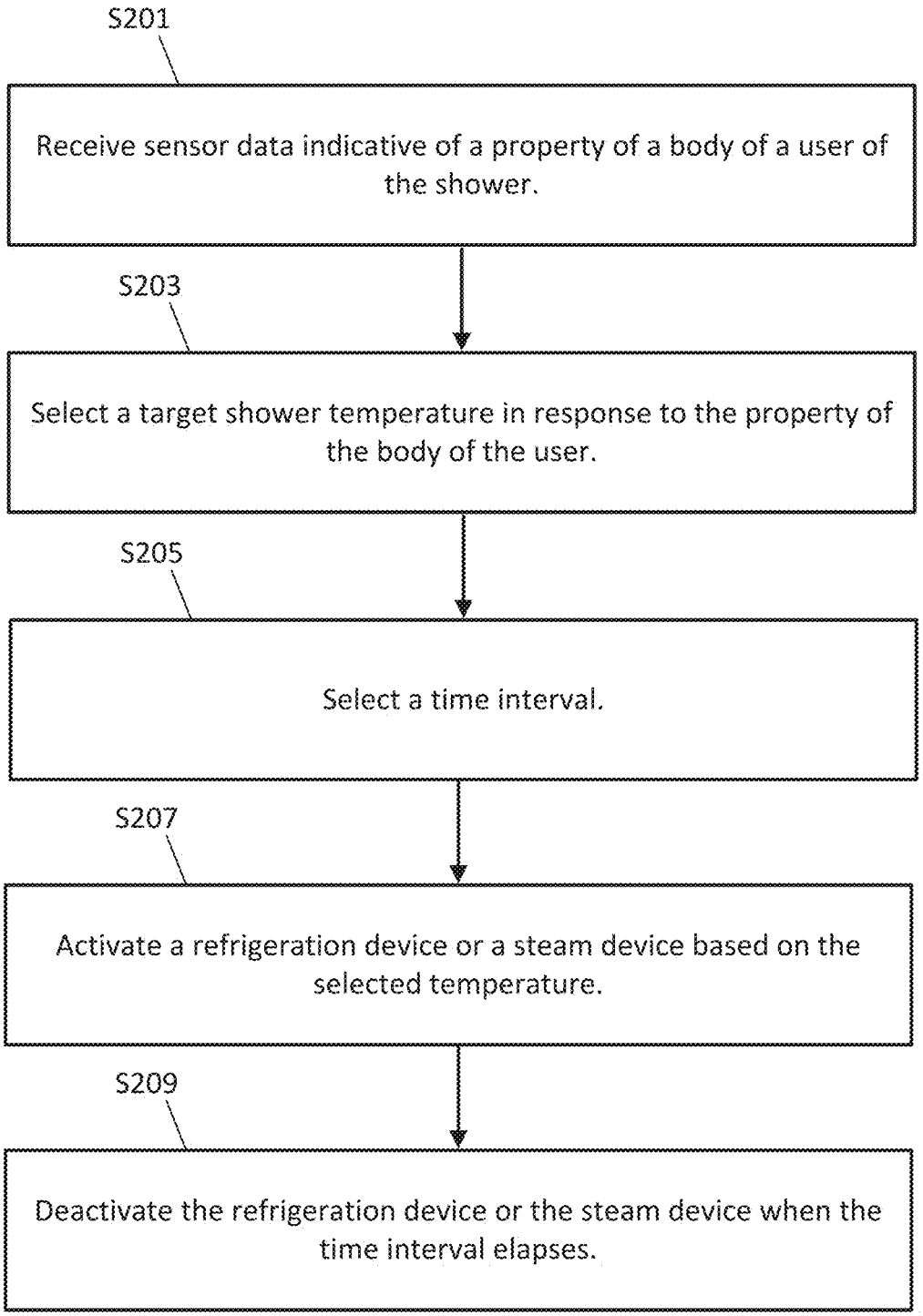
FIG. 7 illustrates an example flow chart for the shower with sensory timing sequence.
Figure 8:
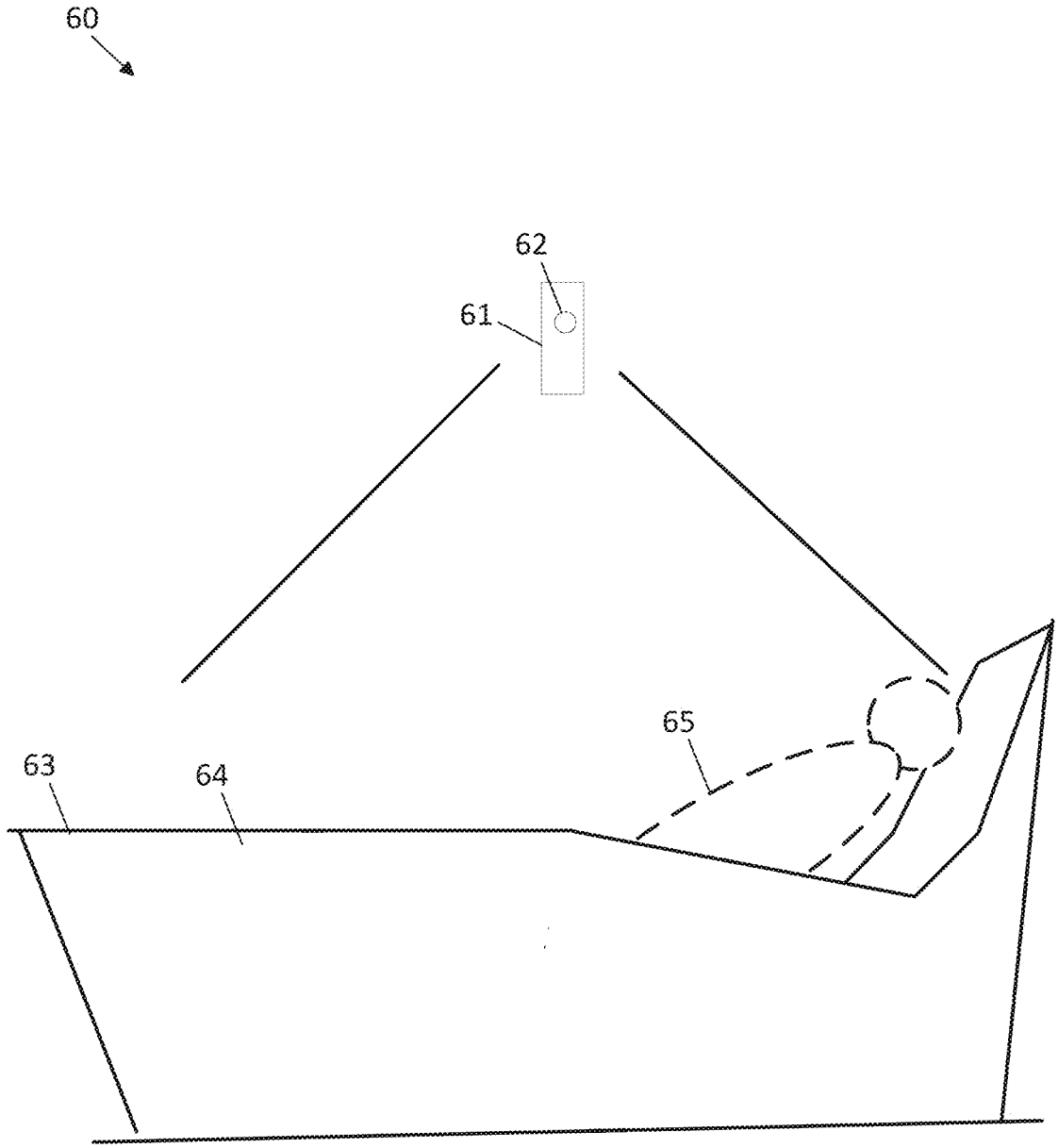
FIG. 8 illustrates an example visual bathtub.

FIG. 8 illustrates an example visual bathtub system 60. The system 60 includes a projector 61, a bathtub 63, and a projection solution 64, including a projection solute dissolved in the water of the bathtub 63. In some examples, the system 60 may also include a motion sensor 62 (e.g., a proximity sensor, a laser, a light detection and ranging (LiDAR) device, a radar device, an infrared camera, a camera, etc.). The system 60 may include a faucet with the timer, light, and other visual cues described with respect to FIGS. 1-4. The system 60 may include the sequences and associated heat exchange devices (refrigeration device, heat device, etc.) as described with respect to FIGS. 5-7. Additional, different, or fewer components may be included.

Figure 9:
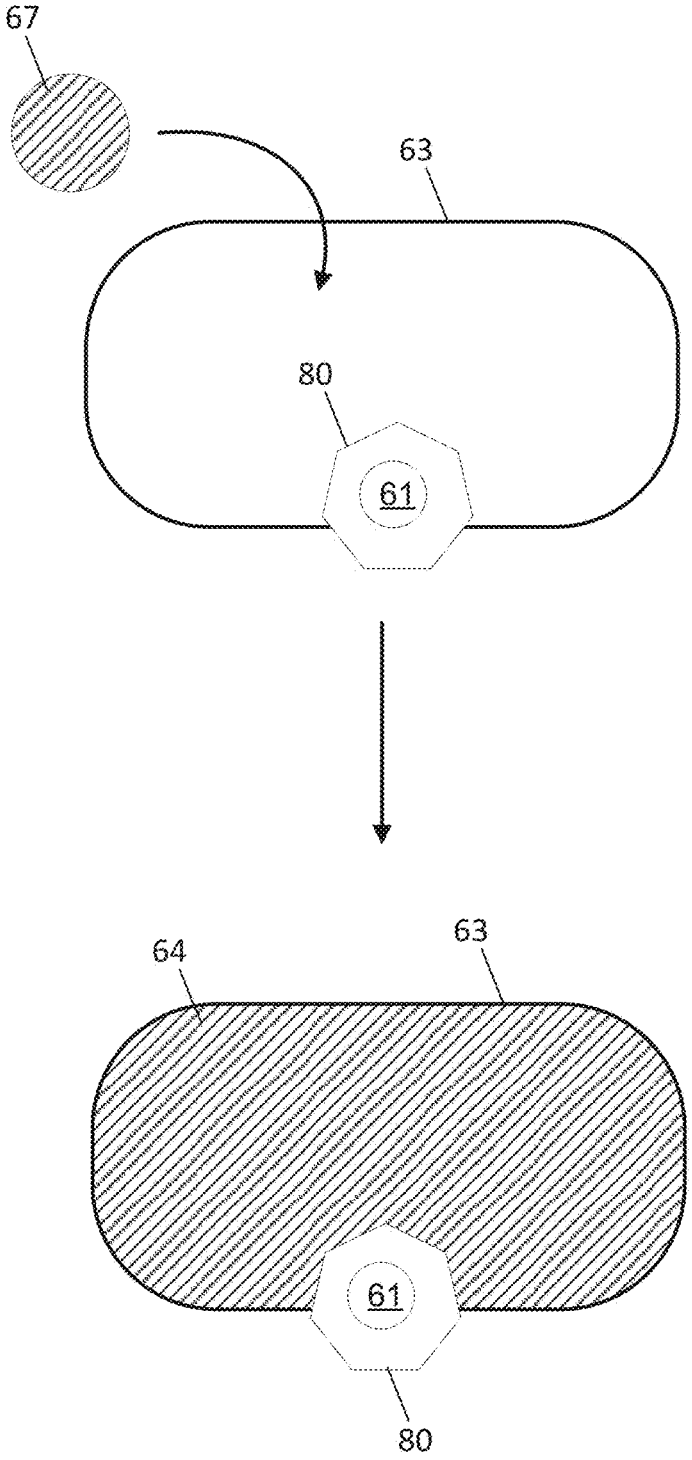
FIG. 9 illustrates an example projection solution for the visual bathtub.

FIG. 9 illustrates a water chandelier 80 collected to the bathtub 63. The water chandelier 80 may support the projector 61 and/or the motion sensor 62 as well as a shower head or other water dispenser. The water chandelier 80 may also include a light or any of the supplemental devices described below. The water chandelier 80 may be coupled to a support connected to the bathtub 63, floor or wall. The water chandelier 80 may include a light or secondary projector as described in FIGS. 1-4. The water chandelier 80 may be operated according to the sequences or heat exchange devices as described in FIGS. 5-8.

FIG. 9 illustrates an example of a solute 67 being placed into a bathtub 63 to create the projection solution 64. The projection solution 64 may be translucent, opaque or partially opaque. The projection solution 64 may have a cloudy, milky, or hazy appearance. The projection solution 64 may allow less light to pass through than water. In this way, some light is reflected. The projector 61 shines light on the projection solution 64 and some light is reflected. Thus, the projection solution causes the projected light from the projector 61 to be visible on the projection solution 64.

The light projected from the projector 61 may have many different forms. The light may include images of a high resolution and/or high frame rate. For example, the light may include video images. The light may include images of a low resolution and/or low frame rate. These images may simulate shadows or nature. Additional examples are described below.

In some examples, the projection solute is a bath bomb. The bath bomb may include dyes, baking soda, salts, cornstarch, oils and other ingredients. At least one of the ingredients partially dissolves in the water to create the translucent projection solution 64. The user may place the bath bomb in the bathtub 63 to create the projection solution 64. In some examples, the bath bomb may cause a thin layer of foam or other translucent material for form on the surface of the water.

A controller 100 may control the projector 61. The controller 100 may include or otherwise be connected to a memory storing the images for the projector 61. The controller 100 access the images and modulates data for the images onto the projected light. In some examples, the controller 100 is mounted to otherwise coupled to the bathtub 63. Wireless signals may be provided to the projector 61. In other examples, the controller 100 may be coupled to the projector 61.

The controller 100 may be triggered to cause the projector 61 to project the images on the projection solute 64 in response to a variety of inputs. In one example, the input may include an instruction from the user such as powering on the controller 100 and/or the projector 61. In addition, the system 60 may include a keypad, switch, button, or other input for providing instructions to the controller 100.

In another example, the input may include gestures or other movements detected by the motion sensor 62. The controller 100 receives data from the motion sensor 62 indicative of movement by the user. The controller 100 may analyze the movement of the user to identify one or more gestures. One gesture may indicate a power operation (e.g., turning on or off the controller 100 and/or the projector 61). One gesture may indicate an image change (e.g., advance the images projected by the projector 61). One gesture may be a configuration or operation of one of the additional peripheral devices described below.

In another example, the input may include an interaction with an object depicted by the projected images. That is, the user may interact with a virtual object that is depicted in the projected image, as detected by the motion sensor 62, and the controller 100 selects a subsequent image in response to the detected motion.

Figure 10:
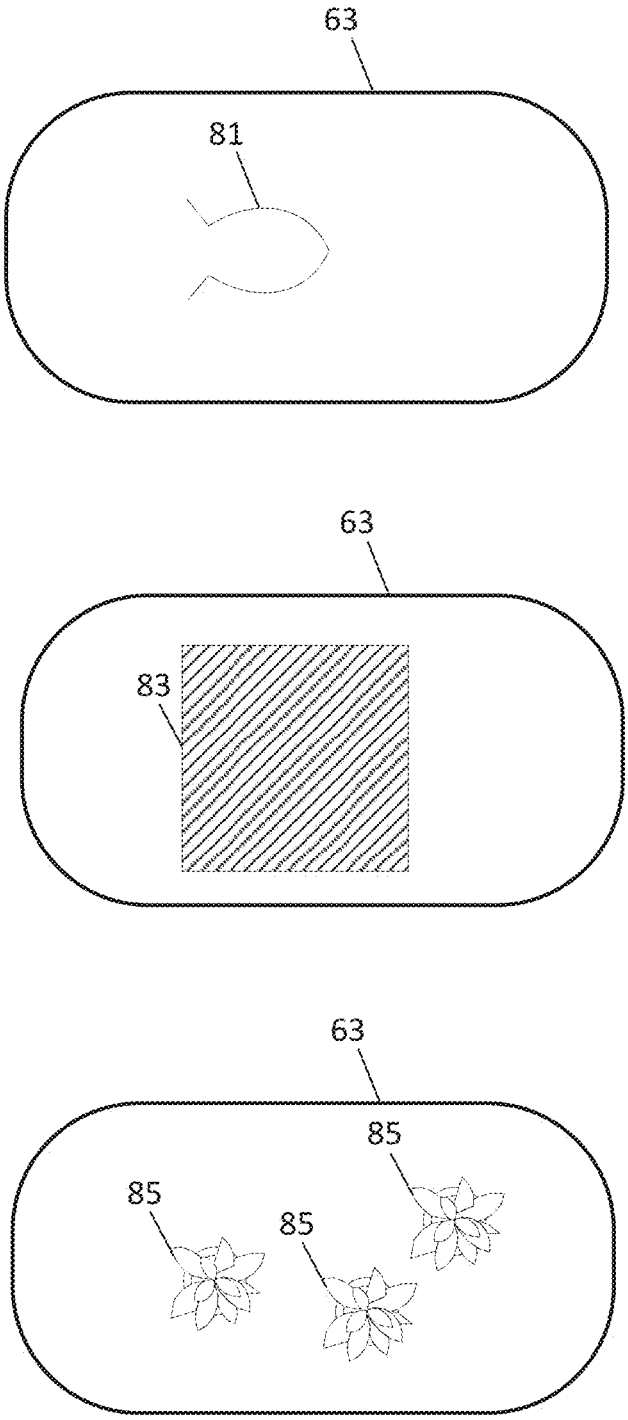
FIG. 10 illustrates example projections for the visual bathtub.

FIG. 10 illustrates some example projected images and interaction with the projected images. In one example, the projected image includes a virtual fish 81. In one example, the projected image includes shadows of leaves 83. In one example, the projected image includes floating flowers 85. A variety of images may be projected on the projection solute.

There are several potential interactions with these images that may be detected with the motion sensor 62 to impact subsequent images selected by the controller 100 and projected by the projector 61. For example, the virtual fish 81 may appear to swim around the bathtub 63 in a series of video images. When the user places a hand or other limb near the virtual fish 81 a subsequent image is selected by the controller 100 that depicts the virtual fish 81 swimming a different direction or otherwise having its path interrupted by the user. Likewise, the user may push against the floating flowers 85 to cause their positions to be modified and appear to float around the bathtub 63.

Figure 11:
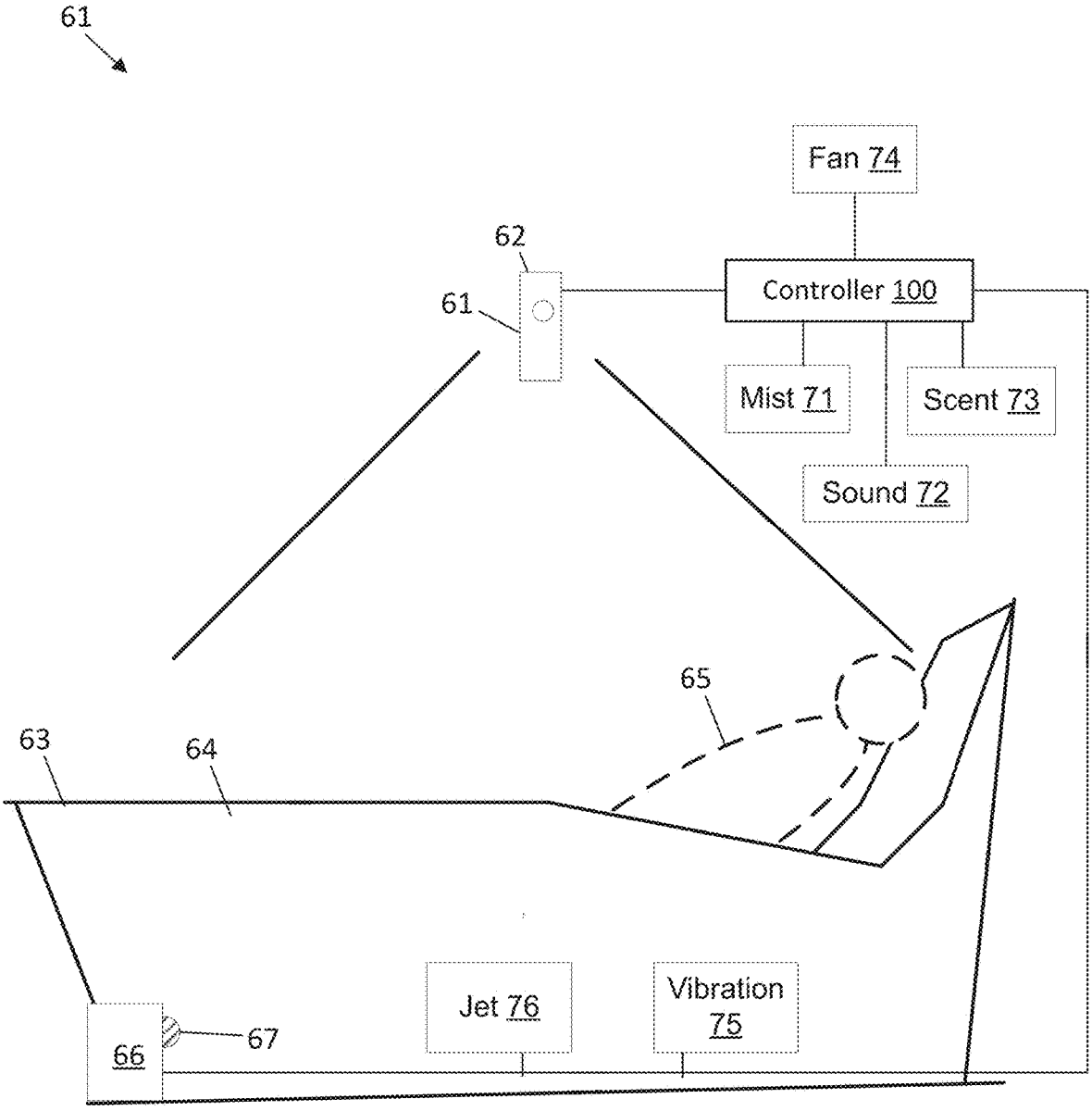
FIG. 11 illustrates another example visual bathtub.
Figure 12:
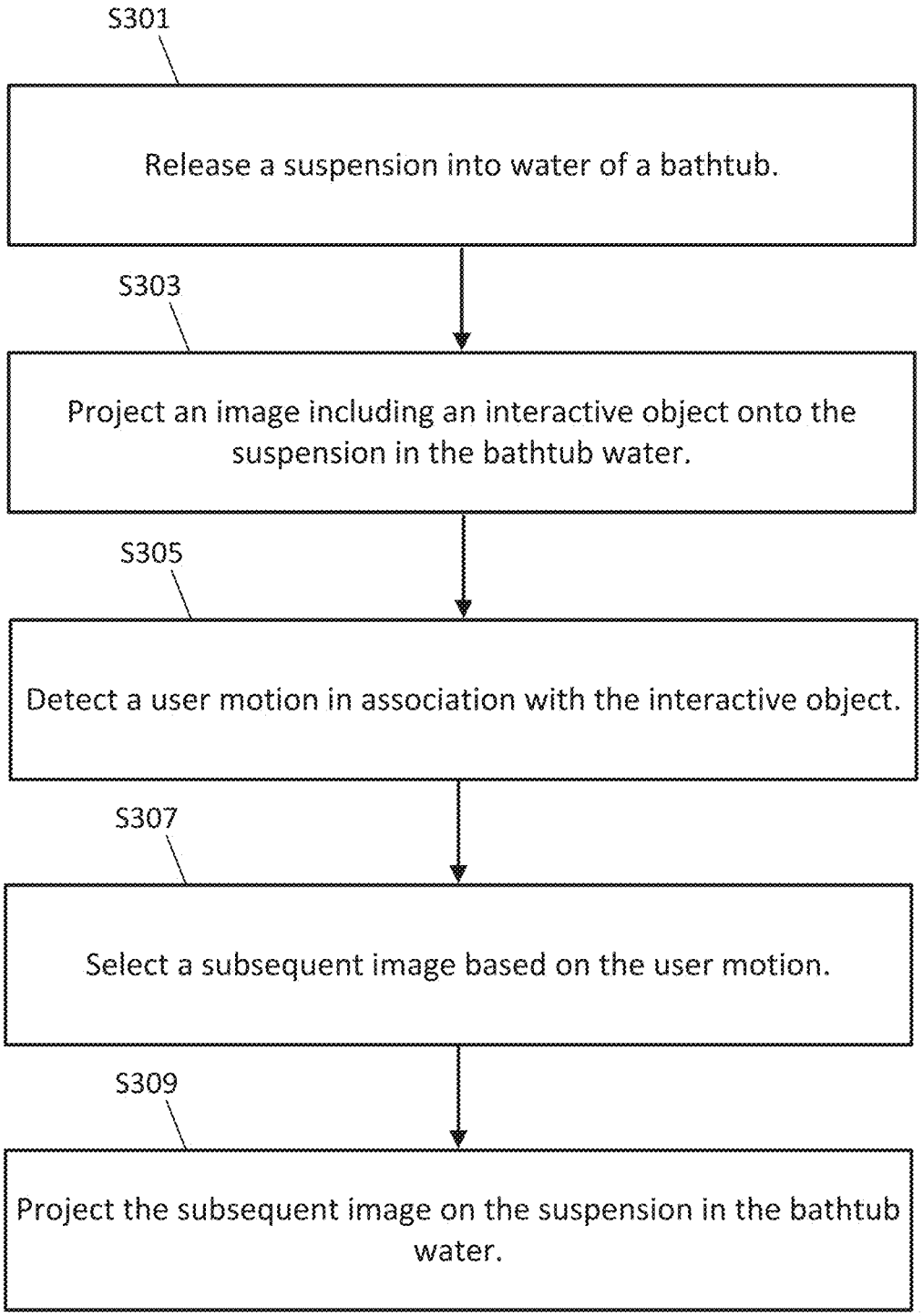
FIG. 12 illustrates an example flow chart for the visual bathtub.

FIG. 11 illustrates another example visual bathtub system 60 including one or more peripheral devices that provide sensations in combination with the projector 61. The peripheral devices may include a solute dispensing device 66, a misting device 71, a speaker or sound device 72, a scent device 73, a fan 74, a vibration device 75, and a jet device 76. Additional, different, or fewer components may be included.

In one example, the bathtub includes the solute dispensing device 66 that is configured to provide the projection solute 67 to the bathtub 63. The solute dispensing device 66 may include a drive mechanism that advances the solute (e.g., bath bomb). The drive mechanism may open a window to release the solute. The drive mechanism may push the solute through a gasket or flexible membrane in order to release the solute into the bathtub 63. The solute dispensing device 66 may also include a lever or spring loaded mechanism that the user can directly actuate to release the solute.

The controller 100 may generate a command to cause the drive mechanism to release the solute into the bathtub 63. The command may be generated in response to a user input (e.g., button press or a gesture detected by the projector 61). The command may be in response to filling the bathtub 63 with water. For example, a fill sensor for the water level of the bathtub 63 may detect a fill level and trigger a signal sent to the controller 100 to cause the solute to be released.

The misting device 71 is a mist machine configured to provide a mist associated with the projected images. The mist may be used when the projected images simulate rain fall. The rain fall may be drops in the water depicted in the projected images. The controller 100 may cause the misting device 71 to produce mist in response to the movements detected by the motion sensor 62 and/or in combination with the projected images.

The speaker or sound device 72 is configured to produce sounds associated with the projected images. The sounds may be raindrops. The sounds may be music. The controller 100 may cause the sound device 72 to produce sounds in response to the movements detected by the motion sensor 62 and/or in combination with the projected images.

The scent device 73 may emit at least one scent associated with the projected images. The controller 100 may cause the scent device 73 to produce scents in response to the movements detected by the motion sensor 62 and/or in combination with the projected images.

The fan 74 is configured to provide an air flow in response to the detected movement of the user. The air flow may be coordinated with the projected image. For example, the air flow may be based on the rustling and movement of the leaves 83. The user may provide input gestures for a fan setting. The controller 100 may cause the fan 74 to operate and at a certain speed in response to the movements detected by the motion sensor 62 and/or in combination with the projected images. The fan 74 may also be triggered when the bathtub 63 is drained to aid in drying the body. Misting and scents may also be provided at drying.

The vibration device 75 may provide a vibration to the bathtub 63. The vibrations may be selected in coordination with the projected image. The controller 100 may cause the vibration device 75 to operate and at a certain interval and frequency in response to the movements detected by the motion sensor 62 and/or in combination with the projected images.

The jet device 76 at least one jet configured to propel water in the bathtub at an interval associated with the projected images. The controller 100 may cause the jet device 76 to operate in response to the movements detected by the motion sensor 62 and/or in combination with the projected images.

FIG. 11 illustrates an example flow chart for the visual bathtub. Additional, different, or fewer components may be included.

At act S301, a controller 100 or other device cause the release of a solute or suspension into bathtub water. At act S303, the controller 100 or projector 61 projects an image including an interactive object on bathtub water including a translucent suspension. At act S305, the controller 100 or a motion sensor 62 detects a user motion associated with the interactive object. At act S307, the controller 100 selects one or more images based on the detected user motion. At act S309, the controller or the projector 61 projects the selected image on the suspension in the bathtub water.

Figure 13:
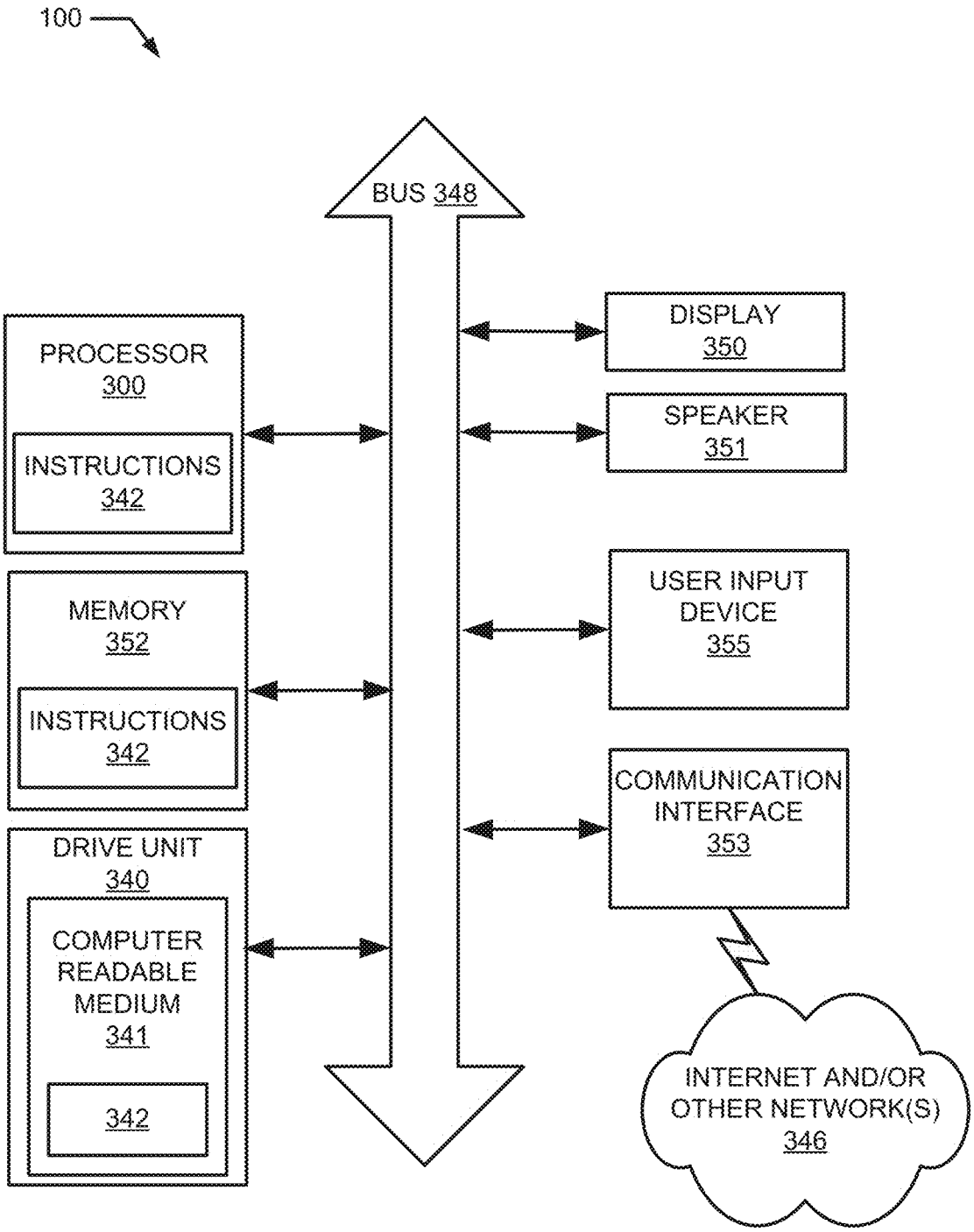
FIG. 13 illustrates an example controller for any of the disclosed embodiments.

FIG. 13 illustrates an example control system or controller 100 for any of the embodiments described herein. The controller 100 may include a processor 300, a memory 352, and a communication interface 353 for interfacing with devices or to the internet and/or other networks 346. In addition to the communication interface 353, a sensor interface may be configured to receive data from the sensors described herein or data from any source. The controller 100 may include an integrated display 350 (projector), speaker 351, or other output devices. The components of the control system may communicate using bus 348. The control system may be connected to a workstation or another external device (e.g., control panel) and/or a database for receiving user inputs, system characteristics, and any of the values described herein.

Optionally, the control system may include an input device 355 and/or a sensing circuit 356 in communication with any of the sensors. The sensing circuit receives sensor measurements from sensors as described above. The input device may include any of the user inputs such as buttons, touchscreen, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be an indicator or other screen output device. The display 350 may be combined with the user input device 355.

Processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, the memory 352 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A timing control system for a faucet for dispensing water, the timing control system comprising:

a valve sensor configured to detect operation of the faucet;

a timer configured to trigger a countdown in response to the operation of the faucet;

a light configured to illuminate the water of the faucet in at least one color in response to the countdown; and a pulsator configured to pulsate the water in response to the countdown.

2. The timing control system of claim 1, further comprising:

a controller configured to select a first color for a first count in the countdown and select a second color for a second count in the countdown.

3. The timing control system of claim 1, wherein the pulsator includes at least one fluidic oscillator.

4. The timing control system of claim 1, wherein the pulsator includes at least one impeller.

5. The timing control system of claim 1, wherein the countdown corresponds to a handwashing duration.

6. The timing control system of claim 1, wherein the light is mounted within the faucet.

7. The timing control system of claim 1, wherein the light is mounted external to the faucet.

8. The timing control system of claim 7, wherein the light is mounted in a basin.

9. The timing control system of claim 8, wherein the valve sensor is associated with a supply line below the basin.

10. A projection timer for a faucet, the projection timer comprising:

a valve sensor configured to detect operation of the faucet;

a controller configured to trigger a countdown in response to the operation of the faucet; and a light configured to illuminate water dispensed by the faucet in response to the countdown, wherein the light includes indicia indicative of the countdown.

11. The projection timer of claim 10, wherein the controller compares the countdown to a threshold and the light is selected in respond to the comparison.

12. The projection timer of claim 10, further comprising:

a pulsator configured to pulsate the water in response to the countdown.

13. The projection timer of claim 12, wherein the pulsator includes at least one impellor or a fluidic oscillator.

14. The projection timer of claim 10, wherein the controller is configured to calculate the countdown based on an exercise routine.

15. A method for a projection handwashing timer, the method:

detecting a flow of water;

setting a countdown in response to the flow of water; and projecting a light on the flow of water, the light indicative of the countdown, wherein the light includes a projection of a number for the countdown.

16. The method of claim 15, further comprising:

determining when the countdown meets or exceeds a threshold, wherein the light is projected in response to the countdown meeting or exceeding the threshold.

17. The method of claim 15, further comprising:

adjusting the projected light in response to a change in the countdown.

* * * * *